United States Patent [19]

Slaughter

[11] 4,377,375

[45] Mar. 22, 1983

[54] APPARATUS FOR FORMING ALLOY POWDERS THROUGH SOLID PARTICLE QUENCHING

[75] Inventor: Edward R. Slaughter, Palm Beach Shores, Fla.

[73] Assignee: United Technologies Corporation, Hartford, Conn.

[21] Appl. No.: 339,810

[22] Filed: Jan. 15, 1982

Related U.S. Application Data

[62] Division of Ser. No. 239,231, Mar. 2, 1981, Pat. No. 4,355,057.

[51] Int. Cl.[3] ..... B28B 1/54

[52] U.S. Cl. ..... 425/8; 264/7; 264/8

[58] Field of Search ..... 264/7, 8; 425/8

[56] References Cited

U.S. PATENT DOCUMENTS

| | | | |
|---|---|---|---|
| 3,752,611 | 8/1973 | Reed | 264/6 |
| 3,795,504 | 3/1974 | Wangeler | 264/8 |
| 4,025,249 | 5/1977 | King | 425/6 |
| 4,053,264 | 10/1977 | King | 425/8 |
| 4,078,873 | 3/1978 | Holiday et al. | 425/8 |
| 4,138,097 | 2/1979 | Boucher et al. | 266/240 |
| 4,140,462 | 2/1979 | Thompson | 425/8 |

*Primary Examiner*—James R. Hall

*Attorney, Agent, or Firm*—Robert C. Walker

[57] ABSTRACT

Methods and apparatus for manufacturing rapidly cooled powder particles is disclosed. Concepts discussed include both convection cooling and conduction cooling of molten material from which the particles are fabricated.

By one effective technique of the present invention, seed particles are dropped across the path of a molten droplet stream causing impact and solidification of the molten droplets on the seed particles. Particles of increased size which are formed of conductively quenched material result.

1 Claim, 2 Drawing Figures

APPARATUS FOR FORMING ALLOY POWDERS THROUGH SOLID PARTICLE QUENCHING

This is a division of application Ser. No. 239,231 filed on Mar. 2, 1981 now U.S. Pat. No. 4,355,057.

DESCRIPTION

1. Technical Field

This invention relates to the manufacture of metal powders, and particularly to the enhancement of the mechanical properties of such powders through rapid solidification of molten alloy into powder form.

2. Background Art

The potential for improving the mechanical and other properties of metallic alloys through rapid solidification of the alloy melt has been recognized in industry since at least the early 1960's. Rapid solidification enables the control of material phase distributions with the result that small amounts of high strength phase material are capable of imparting significantly increased strength characteristics to the solidified alloy.

The RSR$^{TM}$ powder making process developed and refined by Pratt & Whitney Aircraft Group, Division of United Technologies Corporation, is representative of state-of-the-art manufacturing technology for fabricating rapidly cooled powders. That process and embodiments of apparatus useful in performing that process are described in U.S. Pat. Nos.; 4,025,249 to King entitled "Apparatus for Making Metal Powder"; 4,053,264 to King entitled "Apparatus for Metal Powder Making"; 4,078,873 to Holliday et al. entitled "Apparatus for Producing Metal Powder"; 4,140,462 to Thompson entitled "Cooling Means for Molten Metal Rotary Atomizer Means"; and 4,138,096 to Boucher et al. entitled "Combined Crucible and Pouring Spout".

In accordance with the techniques described in the above patents, molten alloy of metallic material is poured onto a rotating disk. The molten material is atomized by the disk as centrifugal forces shear droplets of the molten alloy from the rim of the disk and fling the droplets outwardly from the disk in a radially extending plane. Curtains of cooling gas are directed downwardly across the droplets causing the droplets to solidify into powder particles of the desired material. Convective cooling concepts are employed to cool the droplets with the rate of metal solidification being dependent upon the heat transfer characteristics between the molten droplets and the cooling gas. Cooling rates on the order of ten to the fifth degrees Centigrade per second ($10^{5°}$ C./sec.) are obtained with state-of-the-art apparatus.

Although the concepts described above have proved successful in the formation of powders having desirable mechanical properties, scientists and engineers in industry are continuing to search for yet fundamentally new concepts having enhanced cooling rates and/or improved powder production rates.

DISCLOSURE OF INVENTION

According to the present invention solid particles of rapidly quenched material are formed by impacting seed particles of solid material with droplets of molten material such that the molten material dispersed on the solid material at impact is quenched through conductive heat transfer at the surface of the seed particle to form solid particles of increased size.

In accordance with the specific method taught, molten alloy of the desired composition is poured onto a spinning disk and atomized into a stream of tiny droplets of molten alloy traveling outwardly from the spinning disk in an essentially planar zone extending radially therefrom; seed particles of solid material are dropped into the zone of the molten droplet stream; the seed particles are impacted by the molten droplets causing the molten material to thinly deposit on the seed particles; the molten droplets are solidified upon the solid particles through conductive heat transfer from the molten to the solid material at the surface of the solid material.

Features of the apparatus conceived for solidification of the alloy material in accordance with the present teaching include a rapidly rotatable disk of the type capable of shearing small droplets of molten material from an alloy melt on the surface of the disk. A hopper for the supply of seed particles in an annular array across the path of molten droplets and a hopper for collecting impacted particles with the alloy material solidified thereon are provided.

A principal advantage of the present invention is the ability to produce metal powders having a homogeneous dispersion of alloy constituents throughout the powder particle. High cooling rates enable isolated solidification of high strength phase material to produce powders having superior properties. Increased solubility of solutes, including metastable phases not now capable of being produced by other means, amorphous alloys, or very fine particles of a second material phase, is obtained. The powders have high utility in the fabrication of articles by powder metallurgy techniques. Extremely high solidification rates of molten material on the seed particles results from the employ of conductive cooling concepts. Particles collected in the lower hopper are easily sorted for desired size. Good powder production rates for powders of high quality on a continuing basis are achievable.

The foregoing, and other features and advantages of the present invention will become more apparent in the light of the following description and accompanying drawing.

BEST MODE FOR CARRYING OUT THE INVENTION

Figure 1:
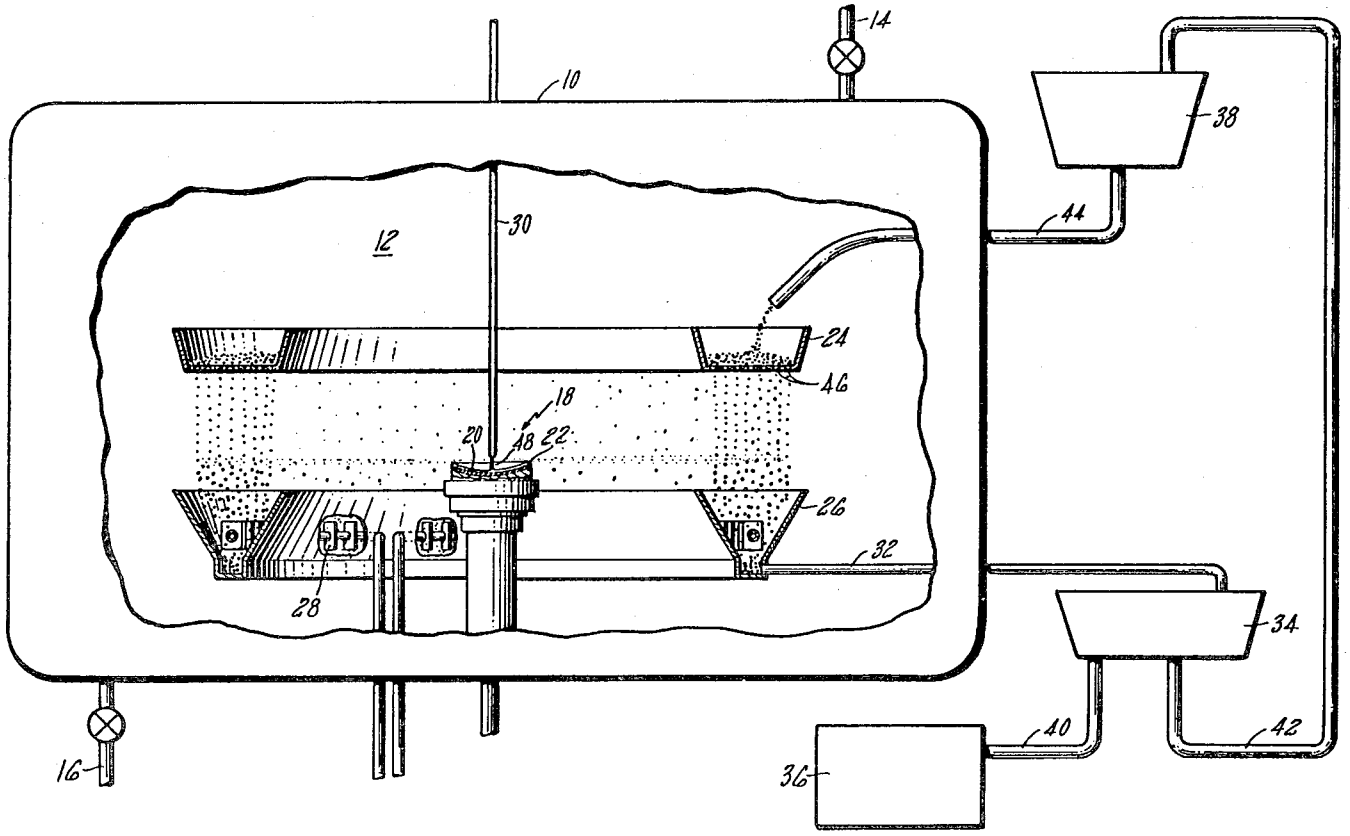
FIG. 1 is a simplified illustration in cross section of apparatus constructed in accordance with the present invention.

Apparatus incorporating concepts of the present invention for achieving rapid cooling rates in powder particle production is illustrated in FIG. 1. An enclosure 10 is provided about the operative elements of the apparatus. The space 12 defined by the enclosure is capable of being sealed from the ambient atmosphere. Conventional means not specifically illustrated is provided for evacuating the space 12 via the discharge manifold 14. Conventional means not specifically illustrated is provided for supplying an inert gas to the space 12 via the supply manifold 16.

The operative elements of the apparatus principally comprise an atomizer disk 18 having a central portion 20 and a circumscribing rim 22, a supply hopper 24 for seed particles and a collecting hopper 26 for receipt of coated particles. A heat exchanger 28 is positioned in the collecting hopper for removing heat from the coated seed particles. Means such as the conduit 30 is provided for flowing molten material onto the central portion 20 of the disk 18. A transfer device 32 is provided for removing coated particles from the hopper 26.

Externally of the enclosure 10 is provided a sorter 34, an end product container 36, and a seed particle container 38. Transfer devices 40 and 42 respectively join the sorter with the end product container and the sorter to the seed particle container. The sorter is of the type capable of classifying sorted particles by size into particles of end product size and undersized particles which are to be recirculated. A transfer device 44 joins the seed particle container with the supply hopper 24. The atomizer disk 18 is of the type used in industry for producing convectively cooled powders. Such a device is illustrated in U.S. Pat. No. 4,207,040 to Metcalf et al entitled "Rotary Atomization Means for the Production of Metal Powders". Other elements of the apparatus are capable of definition by one skilled in the art recognizing the solid particle quenching techniques herein delineated.

The supply hopper 24 illustrated has a donut shaped geometry and has a multiplicity of apertures 46 from which solid particles are dispensable in an annular array centered about the rotatable disk 18.

Figure 2:
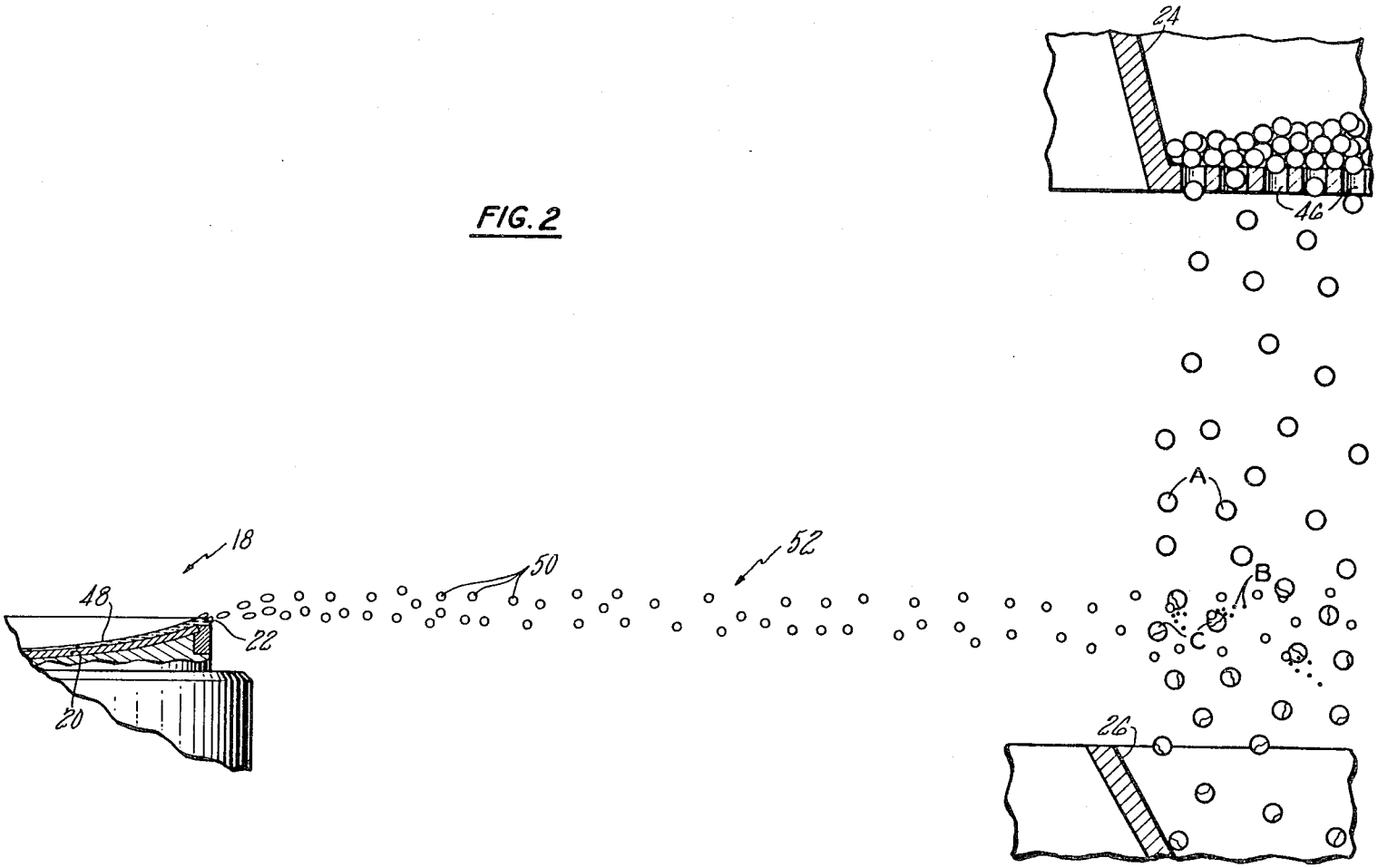
FIG. 2 is an illustration of the solid particle quenching principles employed.

The solid particle quenching technique employed for forming rapidly cooled metal powders is illustrated diagrammatically in FIG. 2. Molten metal 48 having the desired constituent composition is flowed onto the central portion 20 of the atomizer disk 18. Centrifugal forces shear tiny droplets 50 of the molten material from the rim 22 of the disk. The droplets travel outwardly from the disk in a thin stream 52 of dispersing droplets. The distance between droplets increases with distance from the rim of the disk. Simultaneously, seed particles of the solid material having the desired constituent composition are dropped from the supply hopper 24 in a cloud of randomly-spaced particles. The solid particles fall freely through an annular region 52 . The solid, or seed particles become impacted by the tiny droplets of molten material, which adhere to and freeze near instantaneously on the surface of the solid particles. At least a portion of the molten material of some of the droplets, splashes off the solid particles to form yet smaller solid particles which solidify independent or restrike additional solid particles and become adhered thereon.

The random collision of solid and molten particles causes rotation of the solid particles about their respective centers of mass such that additional strikes at random locations deposit a uniform coating buildup upon the solid particles. Surface tension effects in combination with high impact velocities insure good adherence of the molten material onto the solid droplet. Little or no thermal resistance at the interface between molten metal and seed particle is encountered.

The entire process is preferably conducted within an inert atmosphere such that formed particles will be clean and unoxidized. For such a purpose the space 12 within the enclosure 10 is evacuated via the discharge manifold 14. The space is subsequently filled with an inert gas such as via the supply manifold 16. An essentially atmospheric pressure is maintained on the inert gas within the enclosure during operation. Additionally, the atmosphere within the enclosure may be gettered to remove residual contaminants and to remove any contaminants which might be released or carried into the space with the circulated materials.

Practice of the present invention relies upon the employ of solid particle quenching. The mechanism in simplified terms relies on the thermodynamic interaction of tiny droplets of molten material with significantly larger droplets of solid material. Rapid quenching of the molten material through conductive heat transfer results. The initial step includes the providing of solid, small diameter particles having a constituent composition preferably of the desired end product. The particles are referred to as seed crystals in that the small diameter particles upon being repeatedly impacted with molten droplets grow in size until they reach the desired end product diameter.

For a desired end product diameter on the order of eight hundred fifty (850) microns, seed particles having an initial diameter on the order of eighty (80) microns are thought to be an effective starting size. The volume of material in an eighty (80) micron diameter particle is roughly one-tenth of one percent (0.1%) of the volume of material in the eight hundred fifty (850) micrometer diameter end product. Essentially all of the material forming the end product particle is therefore material quenched through the solidification technique described. The inventive concepts may be similarly employed to produce particles of any other practical size.

It is not necessary that the seed particles be formed of rapidly quenched material because, in most cases, the seed particle material is only a very small portion of the end product particle material.

If, however, it is desired to have all of the end product of rapidly quenched material, the seed particles may be manufactured by mechanically crushing a small portion of end product. Ball or rod milling may be used for this purpose. The seed particles are dispersed in random array, falling freely through an annular space which circumscribes the atomizer disk at which the molten particles are to be generated. The seed particles are recirculated through the apparatus on a continuing basis until the particles ultimately reach the desired size.

As the seed particles are falling through the annular space circumscribing the atomizer disk, droplets of molten material are atomized from the rim 22 of the disk. In one effective embodiment droplets of molten material having nominal diameters in the order of eighty (80) microns each are produced. The droplets are flung outwardly from the disk at velocities with respect to the falling seed particles of three hundred fifty (350) feet per second. Upon traverse into the circumscribing space, the molten droplets impact the seed crystals. Random full collisions and partial collisions result. Molten material becomes thinly deposited on the seed crystals A. At least a portion of the molten metal conductively solidifies to form small diameter particles B which may ultimately be utilized as an alternative supply of seed particles.

Random collisions out of alignment with the center of gravity of the seed particles cause the particles to rotate while falling. Subsequent collisions deposit molten material on previously bare portions of the seed particles C.

The molten material spreads rapidly across the impacted surfaces of the seed crystals. The time interval, within an order of magnitude, for spreading of a droplet upon the solid particle which it strikes is equal to the interval for the drop to travel its own diameter prior to impact, about seven and one half times ten to the minus seventh seconds ($7.5\times10^{-7}$ sec.). An eighty (80) micron diameter drop colliding with a seven hundred fifty (750) micron diameter particle, by the above criteria, spreads to form a uniform layer covering one third ($\frac{1}{3}$) of the surface of the particle. The deposited layer is ninety-one hundredths (0.91) microns thick.

In departure from the conventional concepts of the prior art conductive cooling of the molten particle occurs rather than convective cooling. The rate at which such cooling takes place is greatly accelerated over convective cooling rate. According to a United Technologies Corporation Report R75-111321-1 by Greenwald entitled "Calculation of Freezing Rates of Metals" the step temperature profile (constant temperature to a given depth) for a nine tenths (0.9) micron thick liquid layer of nickel wetting solid nickel at room temperature exhibits a cooling rate of ten to the eleventh degrees Fahrenheit ($10^{11}$° F.) per second, or approximately five times ten to the tenth degrees Centrigrade ($5\times10^{10}$° C.) in the liquid layer. Cooling nickel material to one half the melting temperature of seventeen hundred twenty-eight degrees Kelvin (1728° K.), which is for purposes of this discussion fourteen hundred fifty-five degrees Centigrade (1455° C.), requires a temperature drop of eight hundred sixty-four degrees Centigrade (864° C.). The time required for cooling the nine tenths (0.9) micron layer assuming that step function temperature profile would be eight and six tenths times ten to the minus ninth seconds ($8.6\times10^{-9}$ sec.). Since the time required for spreading is roughly one thousand (1000) times as long as the time for cooling of a uniform layer nine tenths of an inch thick, the time for spreading can be considered as the controlling event in the cooling of the droplets. To convert the time for spreading, seven and one half times ten to the minus seventh seconds ($7.5\times10^{-7}$ sec.), to an average cooling rate, assume that the metal cools eight hundred sixty-four degrees Centigrade (864° C.) in that period; in other words, the cooling rate is one and fifteen hundredths times ten to the eighth degrees Centigrade ($1.15\times10^{8}$° C.) per second. The cumulative effect of the above analyzed factors including the spreading time, step function cooling, and the effective particle temperature gradients, lead to a conservative estimate that the cooling rate in accordance with the above concepts to one half the melting temperature of the alloy will be at least two orders of magnitude, or one hundred times, greater than the comparable cooling rate in a convectively cooled system for producing metal powders.

Although the invention has been shown and described with respect to preferred embodiments thereof, it should be understood by those skilled in the art that various changes and omissions in the form and detail thereof may be made therein without departing from the spirit and the scope of the invention.

I claim:

1. An apparatus for forming particles substantially of rapidly quenched metallic material, comprising:

means for generating a stream of droplets of molten metallic material of the composition desired of the particles to be formed, including a rotatable disk onto which molten material is flowable such that droplets of said molten material are sheared from the rim of the disk upon rotation to form a radially emanating stream of molten droplets;

means for dispensing particles of solid material across the stream of molten droplets to intercept said molten droplets and cause said molten droplets to be deposited and rapidly quenched on the particles of solid material, including a donut shaped hopper having apertures therein from which the solid particles are dispensable in an annular pattern across the path of the molten droplet stream, and means for collecting said particles of solid material after said particles have traversed the stream of molten droplets.

* * * * *